US007228719B2

(12) United States Patent
Alchin et al.

(10) Patent No.: US 7,228,719 B2
(45) Date of Patent: Jun. 12, 2007

(54) SLIDING DOOR LOCK

(75) Inventors: Michael Brian Alchin, Mittagong (AU); Richard Zitzelsperger, Wetherill Park (AU)

(73) Assignee: Azuma Designs Pty Limited, New South Wales (AU)

( * ) Notice: Subject to any disclaimer, the term of this patent is extended or adjusted under 35 U.S.C. 154(b) by 0 days.

(21) Appl. No.: 11/019,669

(22) Filed: Dec. 22, 2004

(65) Prior Publication Data

US 2006/0130543 A1 Jun. 22, 2006

(51) Int. Cl.
*E05B 65/08* (2006.01)

(52) U.S. Cl. ..... 70/84; 70/100; 70/121; 70/123; 292/30; 292/51; 292/199

(58) Field of Classification Search ..... 70/121, 70/123, 82, 84, 95–100, 107–111; 292/51, 292/30, 53, 112, 199
See application file for complete search history.

(56) References Cited

U.S. PATENT DOCUMENTS 959,494 A * 5/1910 Fisher ..... 292/51
1,320,444 A * 11/1919 Buczynski et al. ..... 70/97
2,270,219 A * 1/1942 Persson ..... 292/5
3,899,201 A * 8/1975 Paioletti ..... 292/25
4,239,268 A * 12/1980 Rider ..... 292/5
4,754,624 A * 7/1988 Fleming et al. ..... 70/95
4,958,508 A * 9/1990 Lin ..... 70/352
5,482,334 A * 1/1996 Hotzl ..... 292/357
5,561,994 A * 10/1996 Smith et al. ..... 70/99
5,951,068 A * 9/1999 Strong et al. ..... 292/39
6,327,879 B1 * 12/2001 Malsom ..... 70/97
6,502,435 B2 * 1/2003 Watts et al. ..... 70/95
6,508,494 B1 * 1/2003 Reuter et al. ..... 292/51
2004/0245784 A1 * 12/2004 Tsai ..... 292/51
2005/0199025 A1 * 9/2005 West ..... 70/277

* cited by examiner

*Primary Examiner*—Lloyd A. Gall
(74) *Attorney, Agent, or Firm*—Ladas and Parry LLP

(57) ABSTRACT

A lock 10 for a sliding door or window. The lock 10 includes a hollow body 11 within which there is pivotally mounted a pair of hook tongues 14 and 15. The tongues are driven by rack gears 54 which are operated by a lock cylinder 19. The rack gears 54 move linearly in opposite directions to cause angular movement of the tongues 14 and 15 in opposite rotational directions.

17 Claims, 12 Drawing Sheets

SLIDING DOOR LOCK

TECHNICAL FIELD

The present invention relates to locks and more particularly but not exclusively to locks for sliding doors and windows.

BACKGROUND OF THE INVENTION

Locks for sliding doors and windows frequently employ a tongue that is in the form of a "hook". The tongue pivots about an axis generally normal the plane of the door or window and moves angularly between a retracted position within the lock body and an extended position engaging a striker plate or door jamb. For added security it is known to employ two of these tongues. The mechanism to drive these two tongues between the two positions is complex and therefore costly to manufacture. A further disadvantage in that regard is reliability of the lock. It is also difficult to fit the lock within the space provided on the door.

OBJECT OF THE INVENTION

It is the object of the present invention to overcome or substantially ameliorate at least one of the above disadvantages.

SUMMARY OF THE INVENTION

There is disclosed herein a lock including;

a lock body;

a first tongue pivotally mounted in the body for angular movement about an axis, the tongue being moveable between an extended position projecting from the body and a retracted position located at least substantially within the body;

a second tongue pivotally mounted in the body for angular movement about an axis, said second tongue being moveable between an extended position projecting from the body and a retracted position at least substantially located within the body, the axis of said second tongue being generally parallel to the axis of said first tongue;

a first gear rack mounted in the body for movement relative thereto and engaged with the first tongue to cause the movement thereof;

a second gear rack mounted in the body for movement relative thereto and engaged with the second tongue to cause the movement thereof;

drive means to cause movement of both racks in synchronisation in opposite directions so that the tongues move generally in unison in opposite rotational directions between the extended and retracted positions of the tongues, said drive means including a gear meshingly engaged with both racks.

Preferably, said tongues move in a first plane, and said axes are located in a second plane generally perpendicular to said first plane.

Preferably, said lock includes a key operated cylinder which is manipulated by a user to cause movement of the tongues.

Preferably, said cylinder has a longitudinal axis located in said second plane.

Preferably, the racks are located on opposite sides of said second cylinder.

Preferably, said lock includes a user operable member which is manipulated by the user to cause movement of the tongues.

Preferably, said gear is rotated about the axis of said cylinder.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 1:
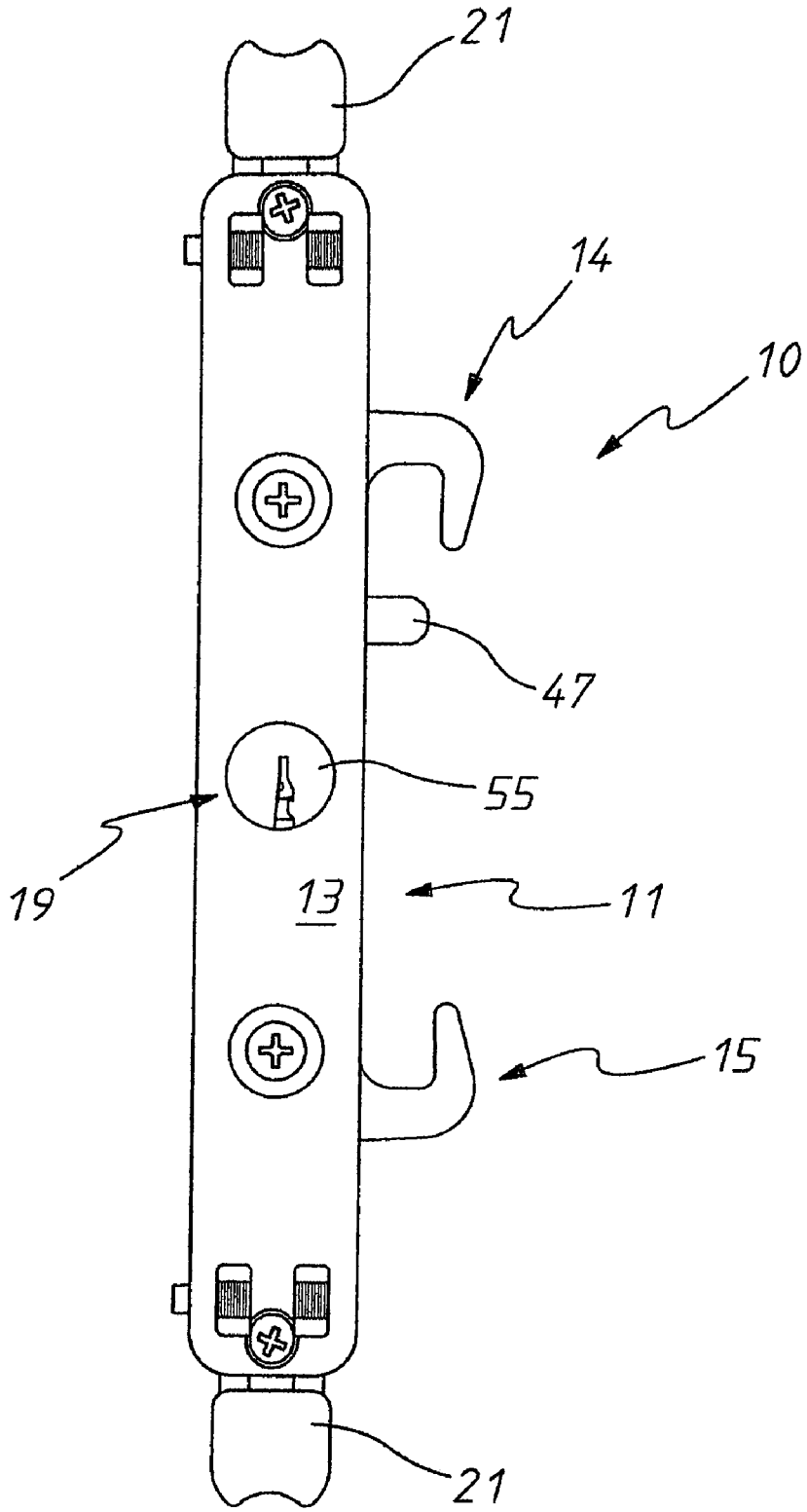
FIG. 1 is a schematic side elevation of a lock for a sliding door.

In the accompanying drawings there is schematically depicted a lock 10 for a sliding door or window. The lock 10 includes a hollow body 11 consisting of a base 12 to which there is secured a front cover 13. Pivotally mounted within the body 11 are tongues 14 and 15 that are of a "hook" configuration so as to provide an attachment portion 16. A threaded fastener 17 secures the cover 13 to the base 12, with cylindrical projections 57 supporting each of the tongues 14 and 15 on the base 12 for pivoting movement about parallel axes 18. The tongues 14 and 15 pivot in a plane generally parallel to the plane of the door or window, while the axes 18 are located in a second plane generally perpendicular the plane within which the tongues 14 and 15 move.

Figure 6:
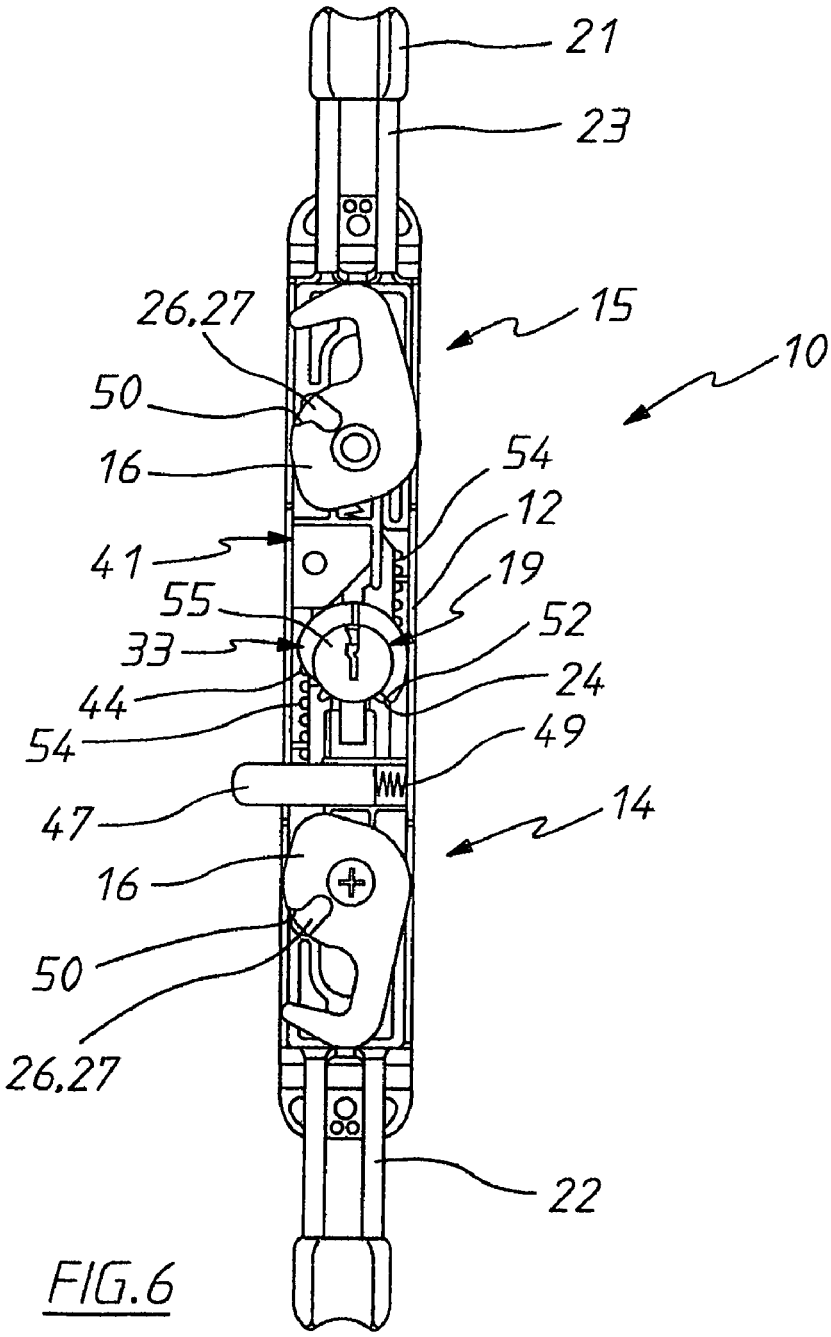
FIG. 6 is a schematic side elevation of the lock of FIG. 1 with the front cover removed and the lock tongues retracted.
Figure 8:
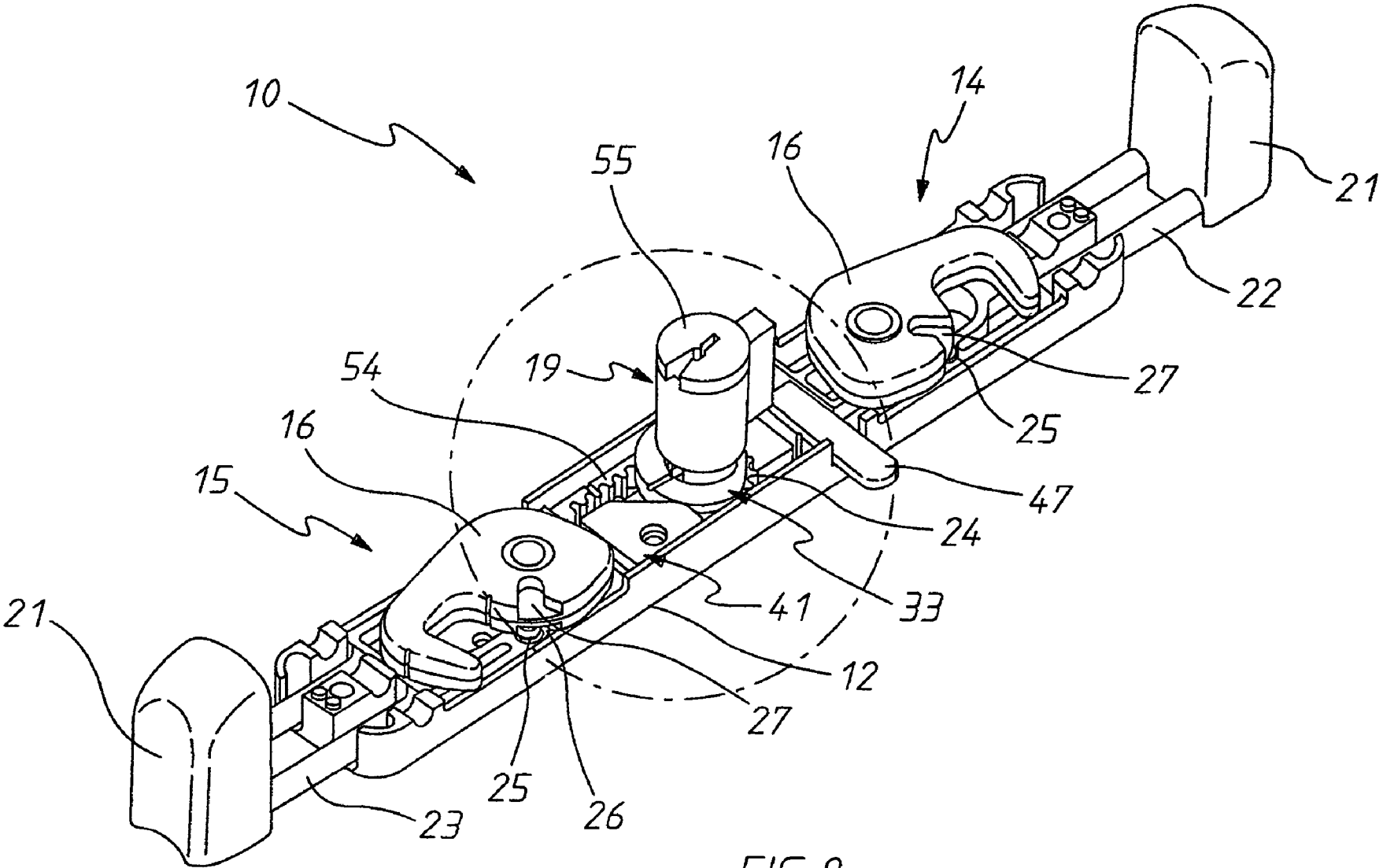
FIG. 8 is a schematic perspective view of the lock as shown in FIG. 6.
Figure 9:
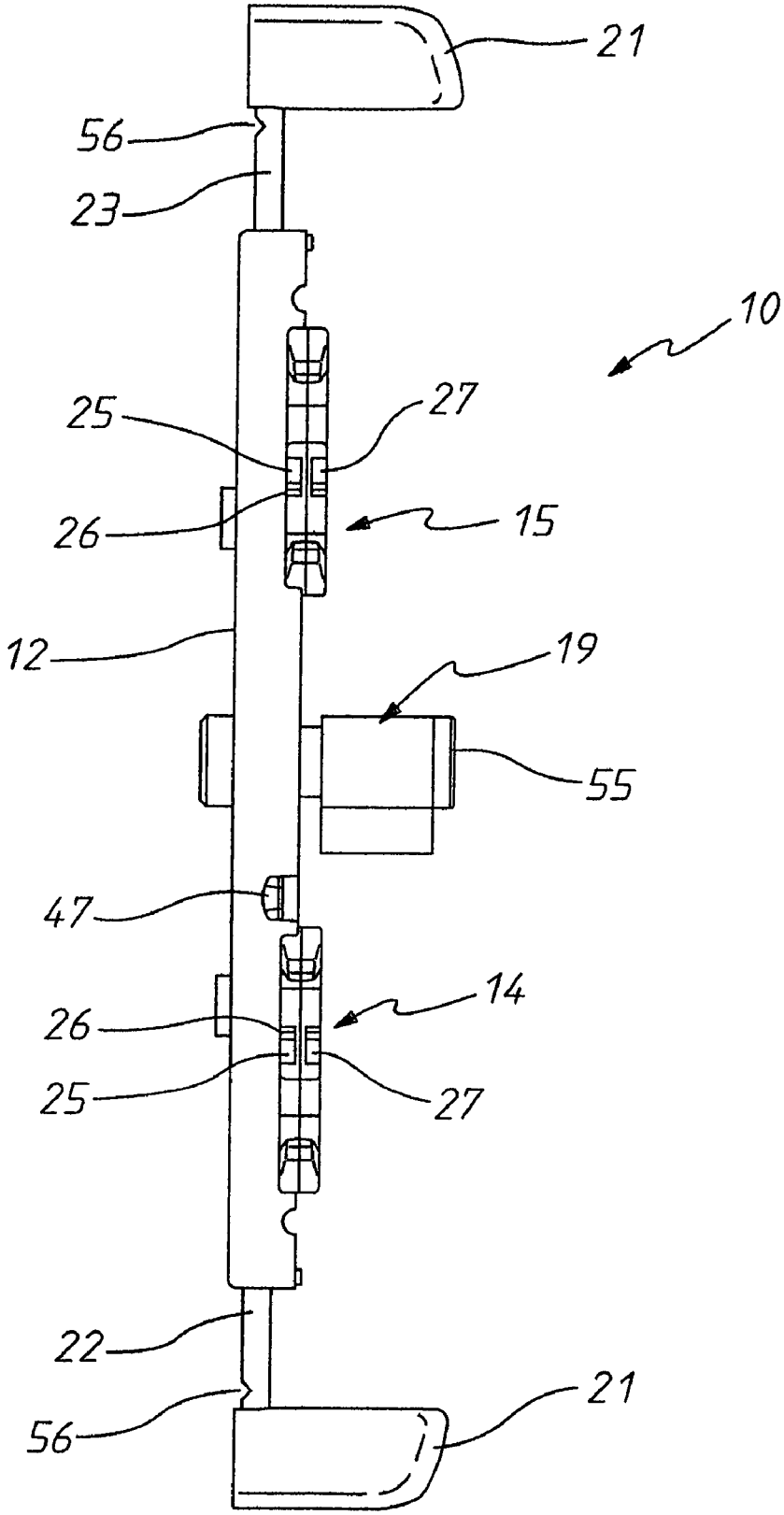
FIG. 9 is a schematic side elevation of the lock as shown in FIG. 8.
Figure 10:
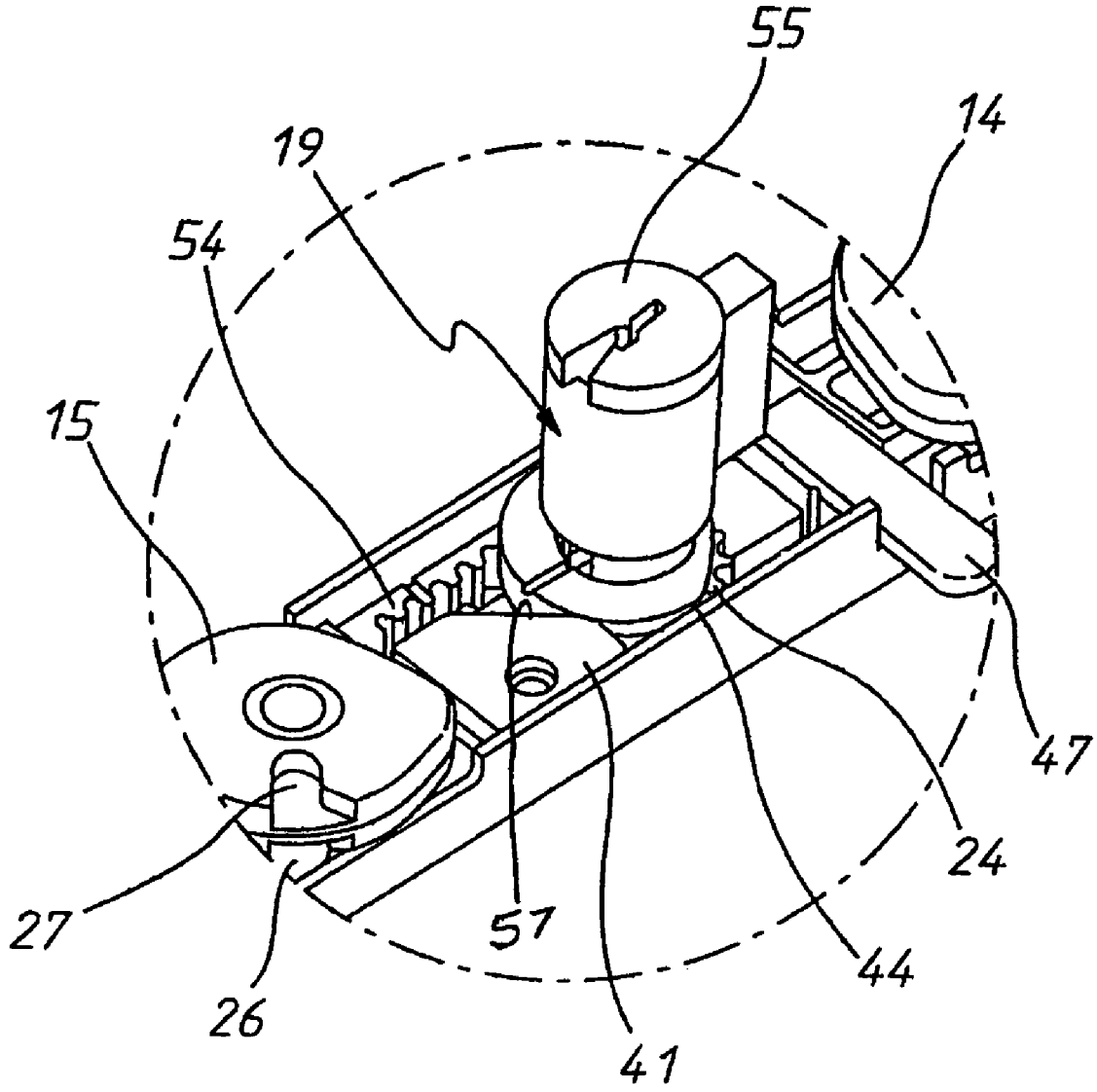
FIG. 10 is a schematic perspective view of the proportion identified in FIG. 8, enlarged.
Figure 11:
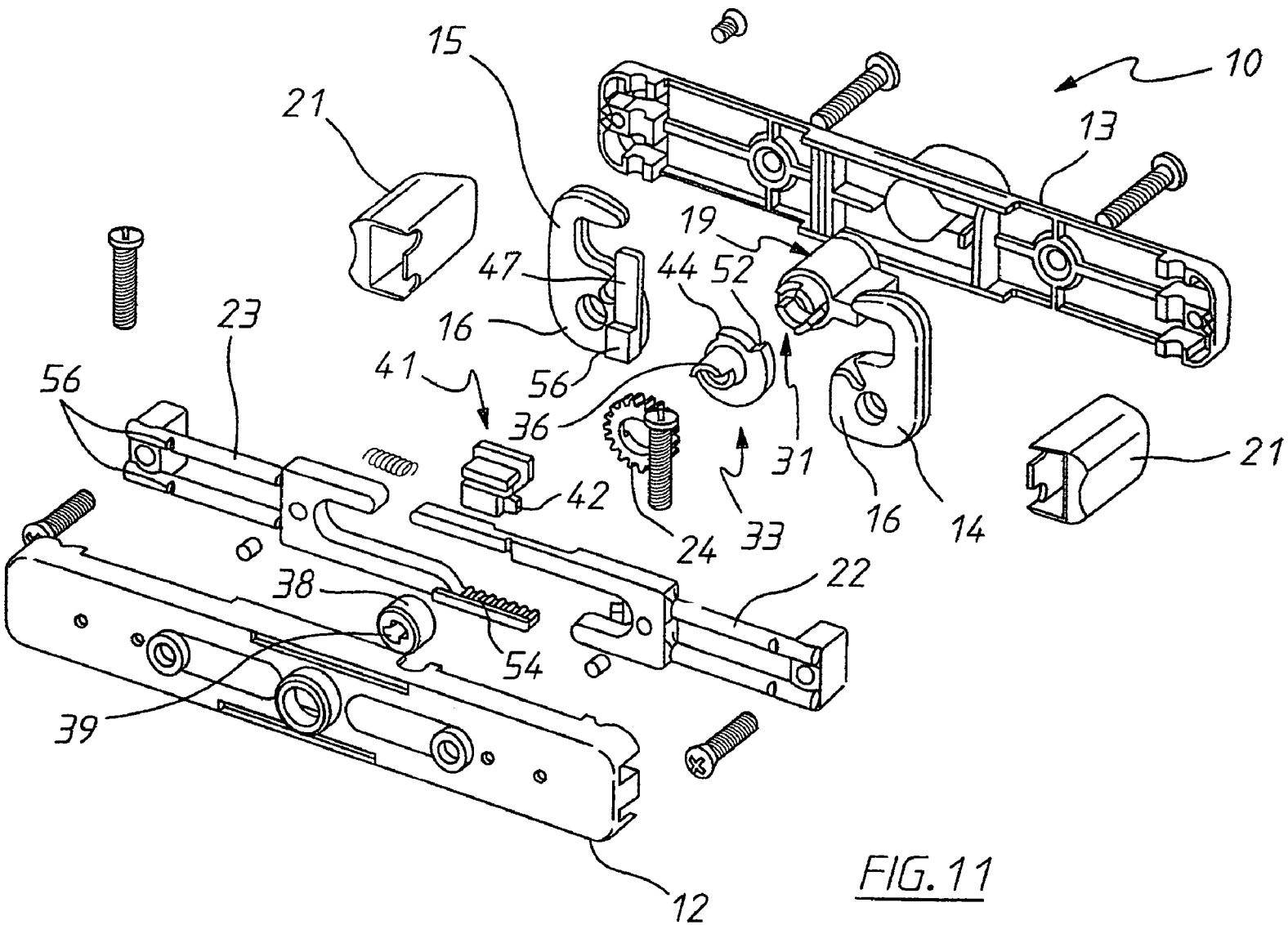
FIG. 11 is a schematic parts exploded perspective view of the lock of FIG. 1 with the tongues in the extended position.
Figure 12:
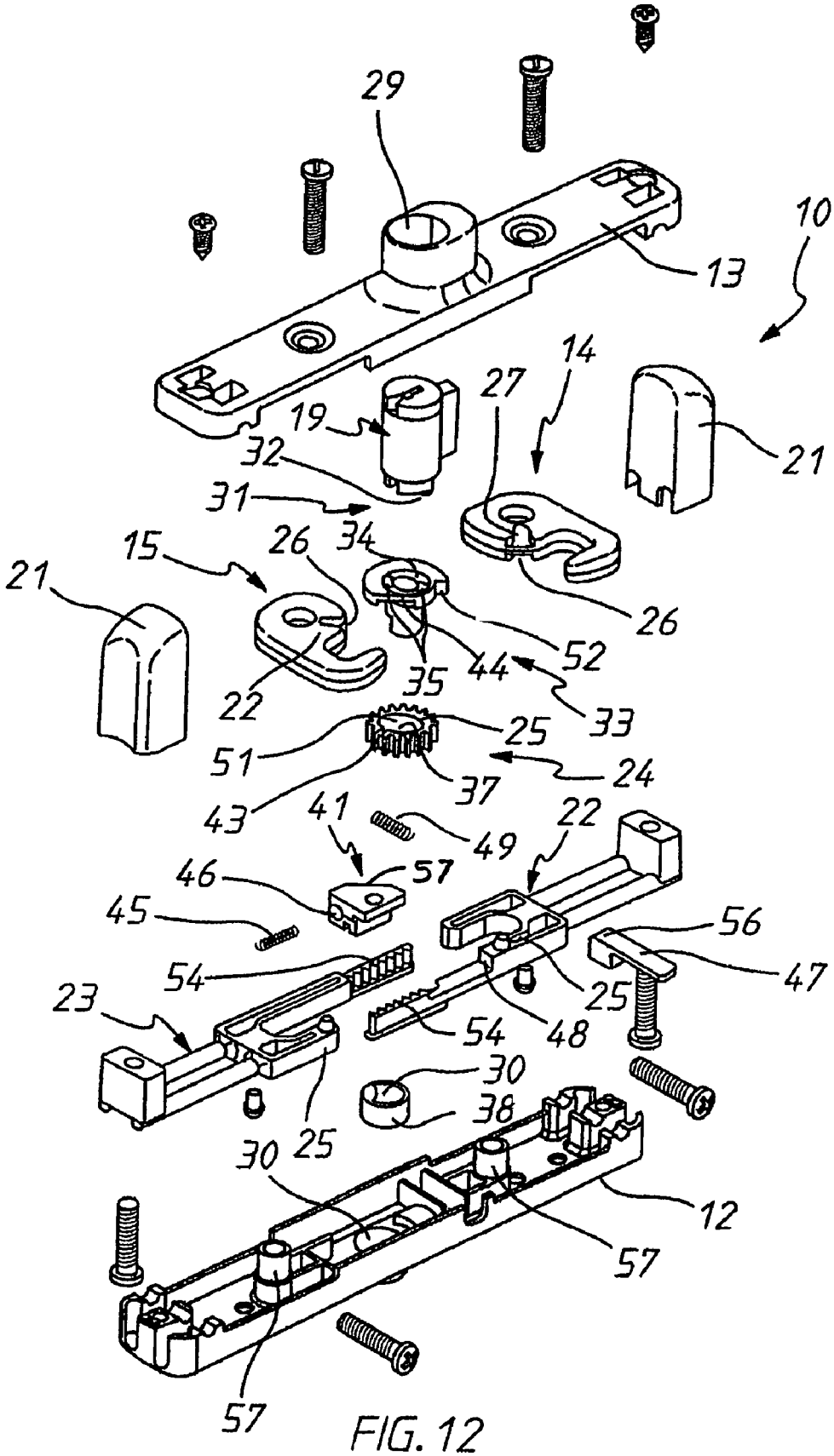
FIG. 12 is further parts exploded perspective view of the lock of FIG. 1 with the tongues in the extended position.
Figure 13:
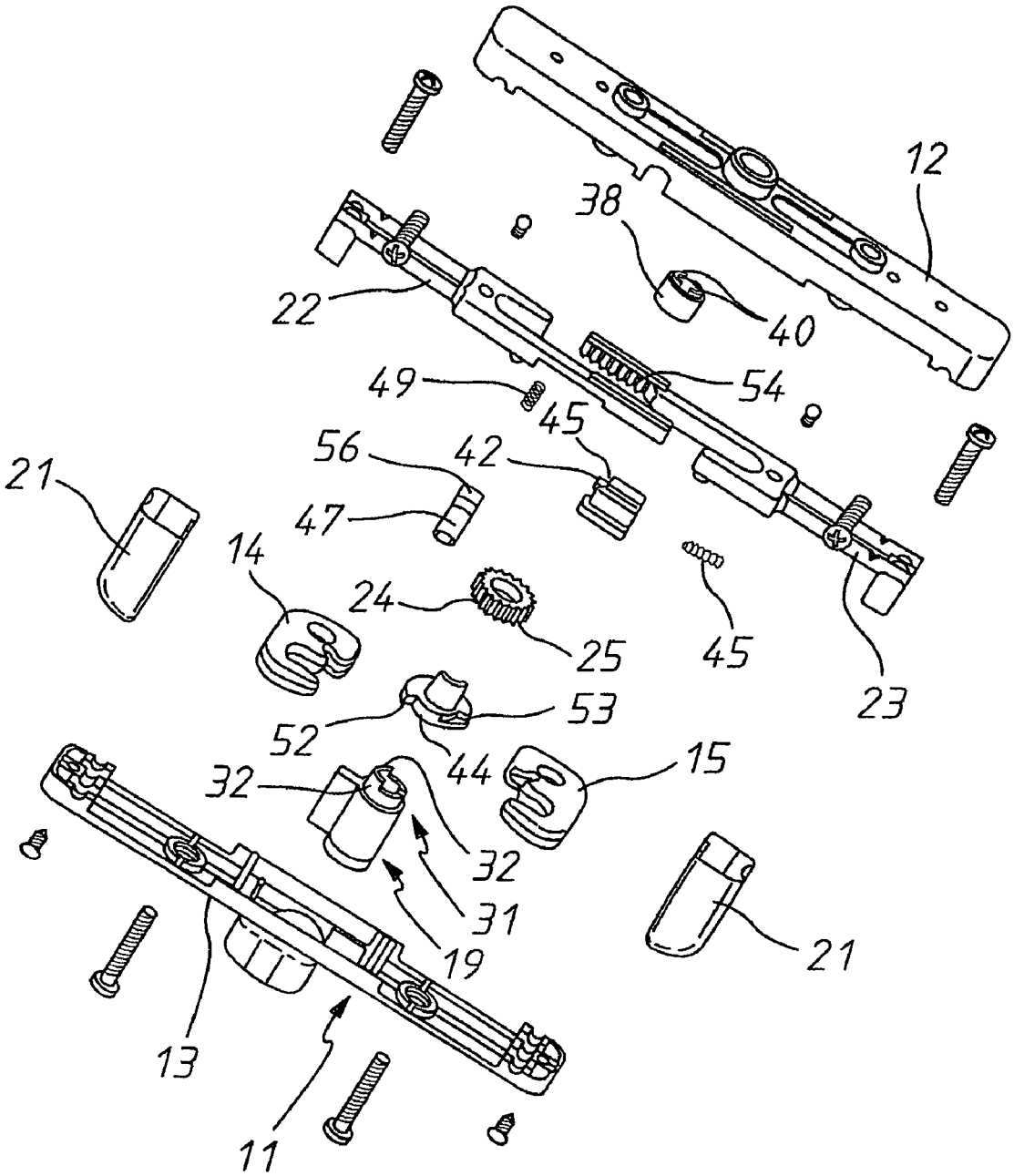
FIG. 13 is a still further parts exploded perspective view of the lock of FIG. 1 with the tongues in the extended position.
Figure 14:
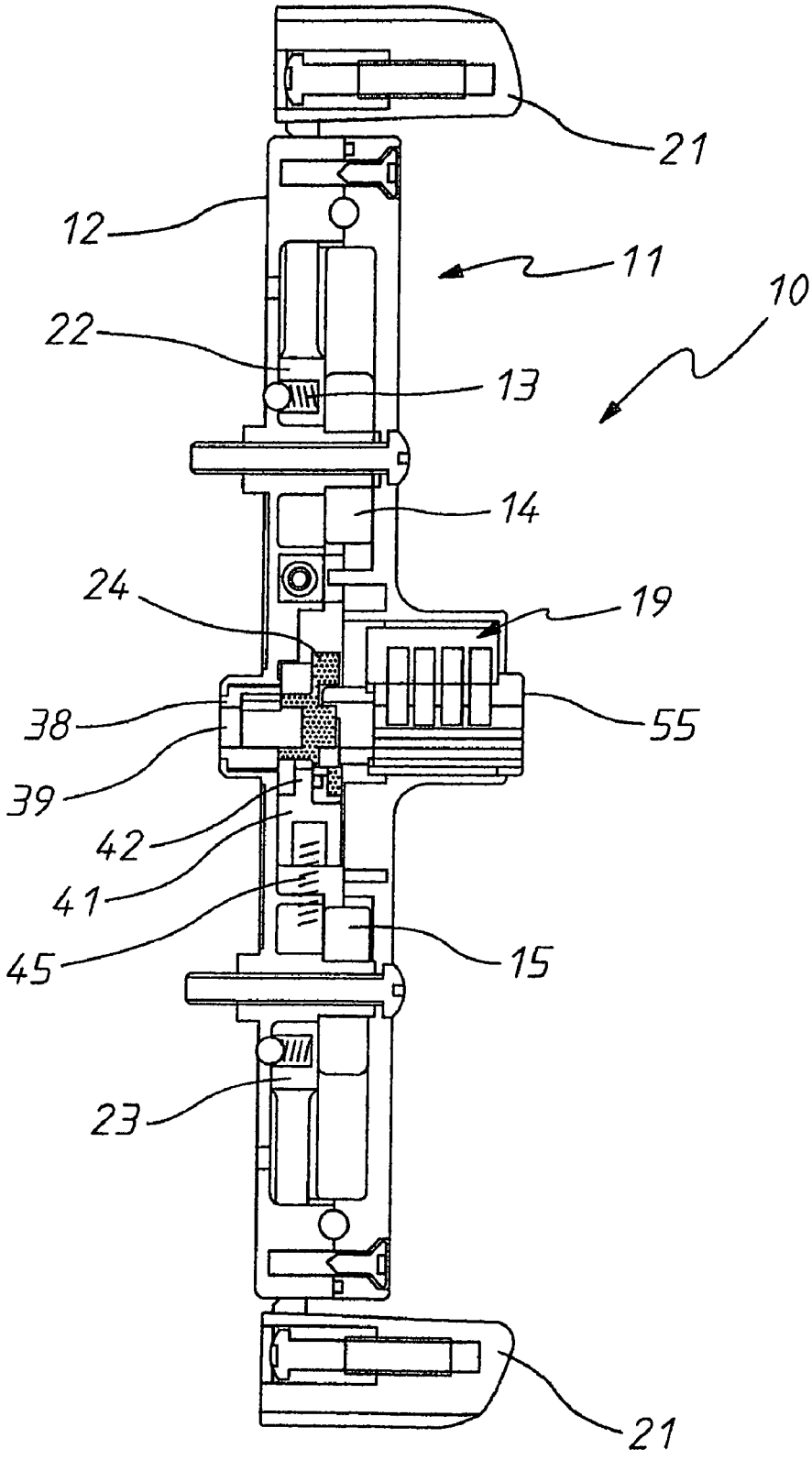
FIG. 14 is a schematic sectional side elevation of the lock of FIG. 1 with the tongues in the extended position.

The tongues 14 and 15 are moved by a key operated lock cylinder 19 that has a barrel 55 which is rotated about an axis 20 by means of a key. The axis 20 is in the same plane as the axis 18. The tongues 14 and 15 are also moved by knob 21. More particularly the cylinder 19 and knob 21 move the tongues 14 and 15 between an extended position (FIG. 2) to engage a striker or door jamb to retain the door in the closed position, and a retracted position (FIG. 6) in which the tongues 14 and 15 are at least substantially retracted within the body 11.

Figure 2:
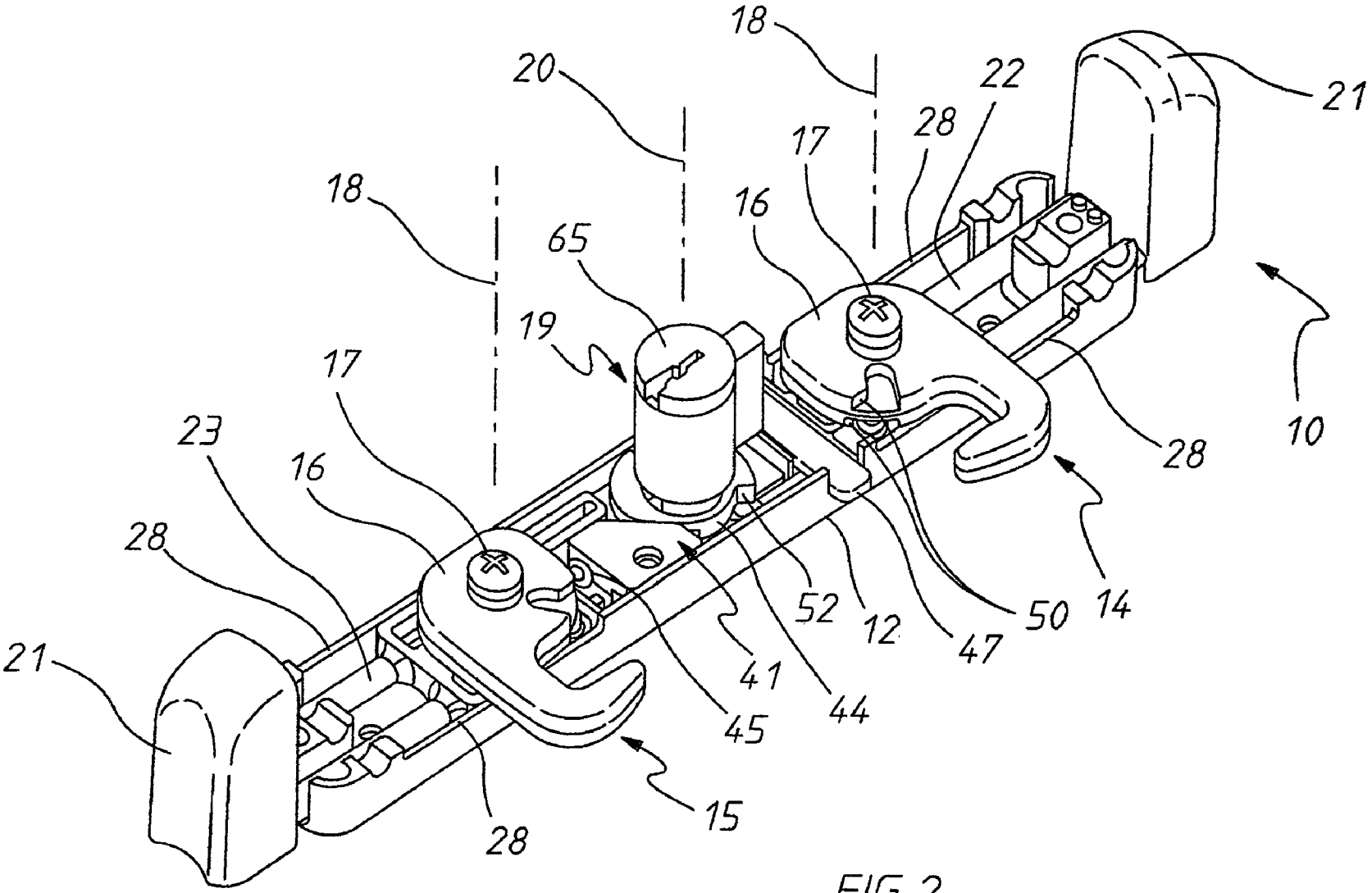
FIG. 2 is a schematic perspective of the lock of FIG. 1 with the front cover removed.
Figure 5:
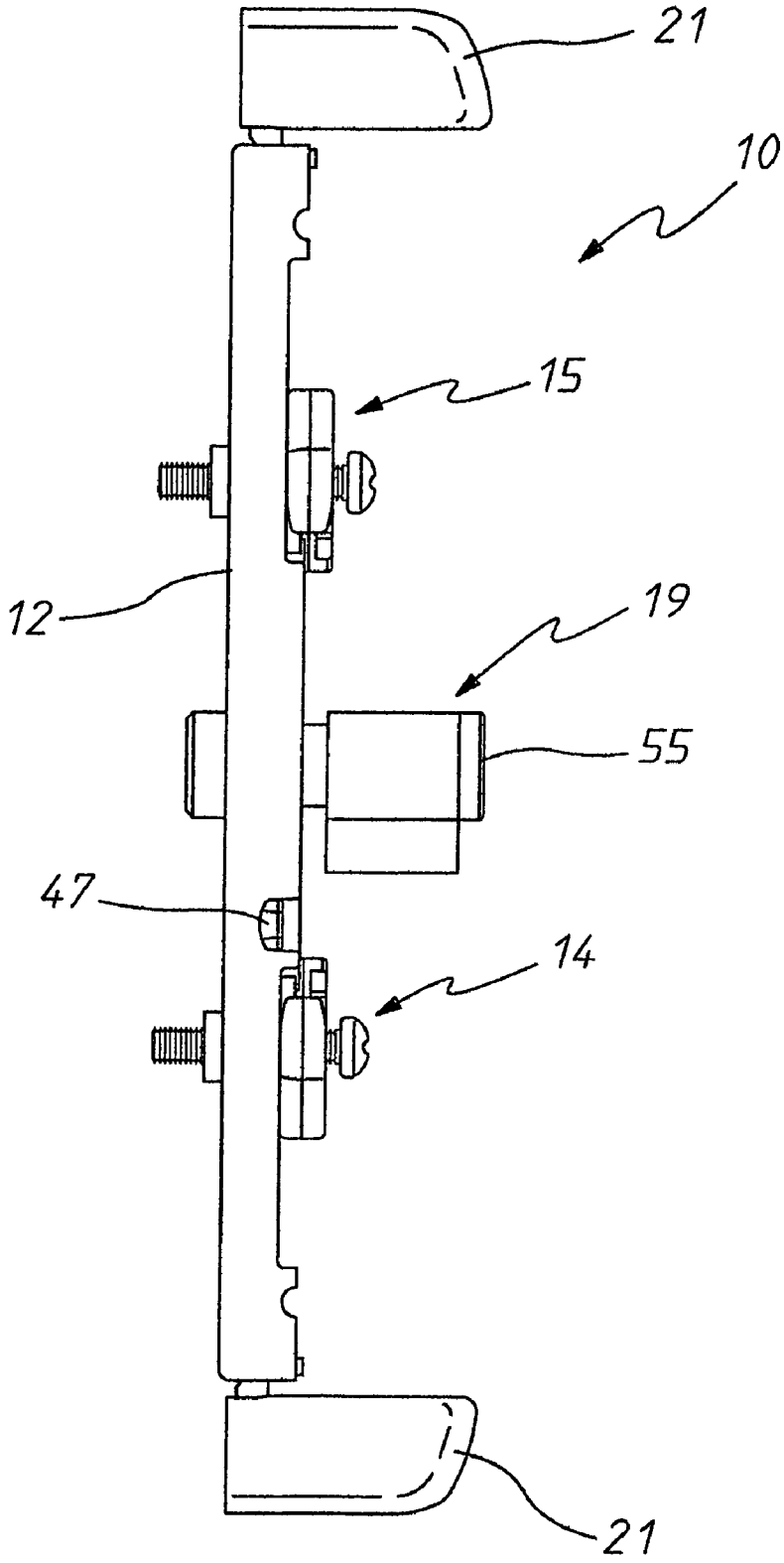
FIG. 5 is a schematic side elevation of the lock as shown in FIG. 3.
Figure 7:
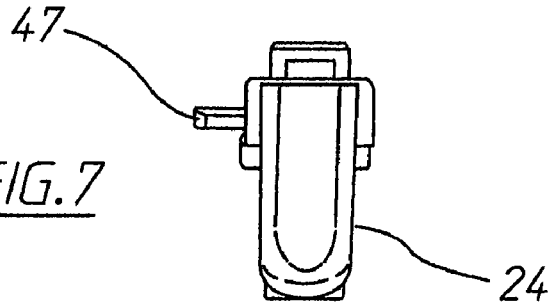
FIG. 7 is a schematic end elevation of the lock of FIG. 6.

As best seen in FIGS. 2 and 5, the knobs 21 project from their slides 22 and 23 in a direction parallel to the axis 20 so as to project beyond the body 11 thereby positioning the knobs 21 so that they may be gripped by a user and moved to in turn move the tongues 14 and 15.

Each knob 21 is attached to a slide 22 or 23, the slides 22 and 23 being slidably guided for linear movement within the base 12 along generally linear paths. The slide 22 and 23 each have a rack gear 54. To ensure that the slides 22 and 23 move in unison (in opposite directions) there is provided a gear 24 meshingly engaged with the gears 54 and located therebetween. The gear 24 rotates about the axes 20. Accordingly as it is easily seen in FIG. 1, the slide 22 and the slide 23 project beyond the body 11, so that each slide 22 and 23 (by grasping the associated knob 21) can be manipulated by a user to move the tongues 14 and 15 as discussed above.

Also as can be seen for example in FIG. 1, the body 11 is elongated, with the slides 22 and 23 projecting from the opposite ends of the body 11.

Each slide 22 and 23 has a projection 25 that engages within a slot 26 in the tongues 14 and 15. Movement of the projections 25 causes pivoting of the tongues 14 and 15 between the extended and retracted positions thereof. As can be noted each tongue 14 and 15 includes a second slot 27 that enables repositioning of the tongues 14 and 15 to change the "hand" of the door. In this particular embodiment the tongues 14 and 15 are shown as being moveable through one side of the base 12. The tongues 14 and 15 may be positioned to project from the other side to change the "hand" of the door. This is achieved by means of the threaded fastener 17. It should further be noted that the base 12 has recesses 28 that enable the tongues 14 and 15 to project from either side of the base 12.

The cylinder 19 projects through the cover 13 via a passage 29. Typically the knobs 21 and cylinder 19 would be located on an internal surface of the door. Associated with the other side of the door is a further lock cylinder (not illustrated) that would be operatively associated with the lock 10 via a passage 30 in the base 12. This further cylinder would have a blade to engage the lock 10.

The gear 24 is also operated by the cylinder 19 as well as the further cylinder, that is the cylinder that projects through the passage 30. The cylinder 19 includes a cam portion 31 including projections 32. The cam portion 31 via the projections 32 drives a cam member 33. More particularly the cam member has a recess 34 within which the projection 32 is received. Within the recess 34 there is provided abutment surfaces 35 that engage the projections 32 so that angular movement of barrel 55 causes angular movement of the cam member 33.

The cam member 33 has an axial projection 36 that extends through the central passage 37 of the gear 24 to engage with an intermediate member 38. The member 38 has a central passage 39, which passage 39 is shaped to co-operate with the projection 36 so that the intermediate member 38 rotates with the cam member 33 but provides for lost angular motion therebetween. The intermediate member 38 is engaged by the blade of the further cylinder, that is the cylinder that projects through the passage 30. More particularly, the intermediate member 38 has abutment surfaces 40 that would engage the blade but provide for lost angular movement therebetween.

Associated with the gear 24 and the cam member 33 is a locking slide 41. Slide 41 has a projection 42 that engages within a recess 43 formed in the gear 24. When engaged with the recess 43 the projection 42 prevents operation of the lock 10 by preventing angular movement of the gear 24. However, the slide 41 is moved from engagement within the recess 43 by means of the cam member 33. The cam member 33 has a cam surface 44 that engages a follower surface 57 on the slide 41 to cause radial movement relative to the longitudinal axis of the cylinder 19 away from the gear 24 to thereby permit movement of the gear 24.

The slide 41 is urged towards the cam member 33 by means of a spring 45. The spring 45 extends into a passage 46 formed in the slide 41.

Associated with the slide 22 is a retaining pin 47 that is operable to engage an abutment face 48 of the slide 22 via step 56. When a door jamb engages the pin 47, the pin 47 is moved to a retracted position basically contained within the hollow body 11. However, when the door is in the open position the pin 47 projects from within the body 11 and engages the face 48 with step 56 to ensure that the tongues 14 and 15 are retained in a retracted position. The pin 47 is urged to its extended position by means of a spring 49.

Figure 3:
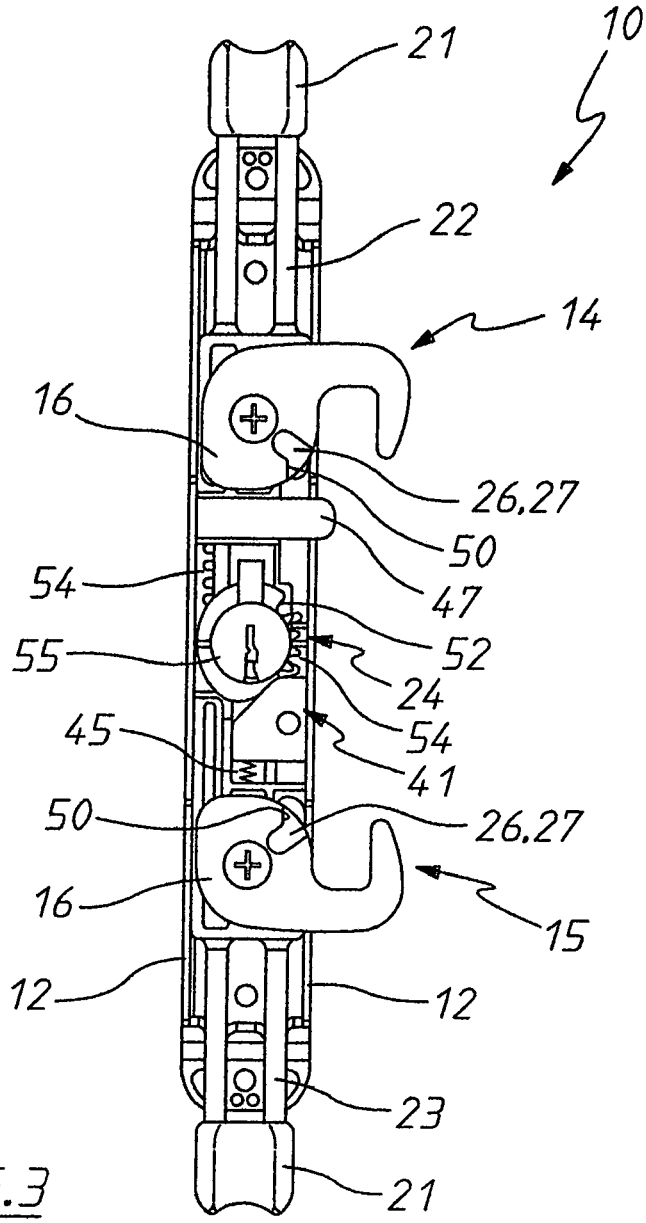
FIG. 3 is a schematic side elevation of a lock as illustrated in FIG. 2.
Figure 4:
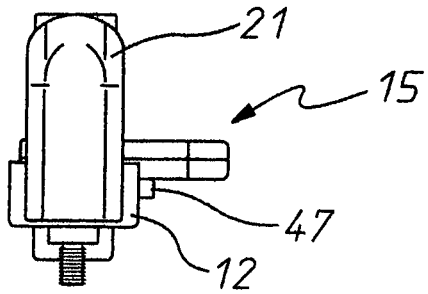
FIG. 4 is a schematic end elevation of a lock as illustrated in FIG. 3.

The tongues 14 and 15 are also retained in the extended position by means of the projections 25 in the slots 26 as best seen in FIG. 3. More particularly each slot 26 (27) has an abutment face 50 that engages the associated projection 25 to prevent direct manipulation of the tongues 14 and 15 to retract them.

The gear 24 is caused to move angularly by the cam member 33 via two abutment faces 52 and 53. The abutment face 52 is adjacent a portion of the cam surface 44 at which the cam surface 44 permits the projection 42 to enter the recess 43. The abutment face 53 is adjacent that portion of a cam surface 44 that maintains the slide 41 spaced from the cam member 33 so that the projection 42 is not engaged with the recess 43. Accordingly, when the tongues 14 and 15 are to be locked in engagement with the door jamb the cam member 33 is moved so that the face 52 engages the projection 51 on the gear 24 and moves the gear 24 so that the recess 43 is aligned with the projection 42. The gear 24 is then locked in position. When the door is to be opened one of the cylinders is operated via a key and the cam member 33 moved angularly so that the cam surface 44 moves the slide 41 to withdraw the projection 42 from within the recess 43. Thereafter the surface 53 engages the projection 51 and causes angular movement of the gear 24. Angular movement of the gear 24 moves slides 22 and 23 to retract the tongues 14 and 15.

The above described two cylinders are both operable to locate the cam member 33 in a position permitting movement of the gear 24 or preventing movement of the gear 24 by allowing the projection 42 to enter the recess 43. For example if the projection 42 is engaged with the gear 24 and a user operates the external cylinder with a key the operation of the cylinder moves the cam member 33 to move the slide 41 radially outwardly thereby removing the projection 42 from within the recess 43. The gear 24 is then free for angular movement. Further rotation of the key has the face 53 engaging the projection 25 to cause angular movement of the gear 24 and retraction of the tongues 14 and 15. The knobs 21 are therefore free to operate the lock tongues 14 and 15. The same applies to someone operating the inside cylinder 19. In this respect it should be appreciated that the initial angular movement of the key releases the gear 24 for movement. Further operation of either cylinder will then retract the tongues. Alternatively once the gear 24 is free from movement the knobs 21 may be used to retract the tongues 14 and 15.

The slides 22 and 23 are each provided with notches 56 that provide a weakness portion that fractures should the slides 22 and 23 be subjected to excess force. This inhibits operation of the lock 10 when a key should be used.

The invention claimed is:

1. A lock including;

a hollow lock body;

a first tongue pivotally mounted in the body for angular movement about a first tongue axis, the tongue being moveable between an extended position projecting from the body and a retracted position located at least substantially within the body;

a second tongue pivotally mounted in the body for angular movement about a second tongue axis, the second tongue being moveable between an extended position projecting from the body and a retracted position at least substantially located within the body, the second tongue axis being generally parallel to the first tongue axis;

a first slide mounted in the body for movement relative thereto and engaged with the first tongue to cause the movement thereof, the slide having a first rack gear and projecting from within the body so as to provide a portion external of the body;

a second slide mounted in the body for movement relative thereto and engaged with the second tongue to cause the movement thereof, the second slide having a second rack gear;

drive means to cause the rack gears to slide in synchronisation in opposite directions so that the tongues move generally in unison in opposite rotational directions between the extended and retracted positions of the tongues, the drive means including a gear meshingly engaged with the rack gears, the gear being mounted for rotation about a gear axis, the gear axis being generally parallel to the first and second tongue axes; and a user operable member fixed to the first slide and projecting therefrom in a direction generally parallel to the near axis so as to project beyond the body to a position for gripping the user operable member to move thereby the first slide and the first and second tongues.

2. The lock of claim 1 wherein said tongues move in a first plane, and at least two of said axes are located in a second plane generally perpendicular to said first plane.

3. The lock of claim 2 wherein said lock includes a key operated cylinder which is manipulated by a user to cause movement of the tongues.

4. The lock of claim 3 wherein said cylinder has a longitudinal axis located in said second plane.

5. The lock of claim 4 wherein the rack gears are located on opposite sides of said second plane.

6. The lock of claim 5 wherein said gear is rotated about the axis of said cylinder.

7. The lock of claim 6 wherein each tongue is in the form of a "hook" tongue, with the tongues when in the extended position being adapted to engage a striker plate or doorjamb.

8. The lock of claim 1 wherein said lock includes a key operated cylinder which is manipulated by a user to cause movement of the tongues.

9. The lock of claim 8 wherein said cylinder has a longitudinal axis located in said second plane.

10. The lock of claim 9 wherein the rack gears are located on opposite sides of said second plane.

11. The lock of claim 10 wherein said gear is rotated about the axis of said cylinder.

12. The lock of claim 11 wherein each tongue is in the form of a "hook" tongue, with the tongues when in the extended position being adapted to engage a striker plate or doorjamb.

13. The lock of claim 2 wherein each tongue is in the form of a "hook" tongue, with the tongues when in the extended position being adapted to engage a striker plate or doorjamb.

14. The lock of claim 1 wherein each tongue is in the form of a "hook" tongue, with the tongues when in the extended position being adapted to engage a striker plate or doorjamb.

15. The lock of claim 1, and further including a further user manipulated member fixed to the second slide so as to project therefrom beyond said body to a position for gripping the further user manipulated member to move thereby the second slide and the first and second tongues, whereby either slide can be manipulated to cause movement of the tongues.

16. The lock of claim 1, wherein said body is elongated so as to have opposite ends, with the first and second slides respectively projecting from the opposite ends.

17. The lock of claim 15, wherein said body is elongated so as to have opposite ends, with the first and second slides respectively projecting from the opposite ends.

* * * * *